US007774983B2

(12) United States Patent
Shimura et al.

(10) Patent No.: US 7,774,983 B2
(45) Date of Patent: Aug. 17, 2010

(54) DOOR OPENING DEVICE IN A VEHICLE

(75) Inventors: Ryoji Shimura, Yokohama (JP); Hidemasa Hirakui, Kai (JP)

(73) Assignee: Mitsui Mining and Smelting Co., Ltd. (JP)

( * ) Notice: Subject to any disclaimer, the term of this patent is extended or adjusted under 35 U.S.C. 154(b) by 151 days.

(21) Appl. No.: 11/739,374

(22) Filed: Apr. 24, 2007

(65) Prior Publication Data

US 2007/0245632 A1 Oct. 25, 2007

(30) Foreign Application Priority Data

Apr. 25, 2006 (JP) ..... 2006-120001

(51) Int. Cl.
*E05F 15/10* (2006.01)

(52) U.S. Cl. ..... 49/341; 49/340; 296/146.4

(58) Field of Classification Search ..... 49/339, 49/340, 341; 296/146.4, 146.8
See application file for complete search history.

(56) References Cited

U.S. PATENT DOCUMENTS

| | | | | |
|---|---|---|---|---|
| 6,367,199 | B2 * | 4/2002 | Sedlak et al. | 49/340 |
| 6,767,048 | B2 | 7/2004 | Yokota | 296/146.4 |
| 6,799,790 | B2 * | 10/2004 | Sakai et al. | 296/146.8 |
| 2001/0047625 | A1 * | 12/2001 | Sedlak et al. | 49/341 |
| 2005/0076571 | A1 * | 4/2005 | Hattori et al. | 49/341 |

* cited by examiner

*Primary Examiner*—Gregory J. Strimbu
(74) *Attorney, Agent, or Firm*—Ostrolenk Faber LLP

(57) ABSTRACT

A door is pivotally secured to the back of a vehicle. A door opening device comprises a connecting rod including an upper end and a lower end. The upper end of the connecting rod is pivotally mounted to the door. The door opening device further comprises a guide member having a guide slit, a rack bar which slides up and down in the guide slit, a connecting shaft that pivotally connects the lower end of the connecting rod to an upper end of the rack bar and a driving unit for opening and closing the door via the connecting rod. The lower end of the connecting rod is pivotally coupled to the upper end of the rack bar.

3 Claims, 6 Drawing Sheets

DOOR OPENING DEVICE IN A VEHICLE

BACKGROUND OF THE INVENTION

The present invention relates to a door opening device in a vehicle.

In U.S. Pat. No. 6,767,048B2, a known door opening device in a vehicle comprises a connecting rod; a guide member fixed to a vehicle body so that its length extends vertically; a rack bar supported by the guide member to move vertically; and drive means which moves the rack bar up and down to open and close the door via the connecting rod.

However, in the door opening device in a vehicle, the rack bar is disposed to move up and down along one side surface of the guide member facing the outside of a case. The connecting rod is disposed to move up and down along the other side surface of the guide member facing the inside of the car. A lower part of the connecting rod and an upper part of the rack bar are connected with a connecting shaft which passes through the guide member thereby making connecting operation troublesome and the shape of the connecting rod complicate.

SUMMARY OF THE INVENTION

In view of the disadvantages, it is an object of the invention to provide a door opening device in a vehicle in which a connecting rod pivotally coupled to a door of the vehicle is easily coupled to a rack bar to simplify the structure.

BRIEF DESCRIPTION OF THE DRAWINGS

The features and advantages of the invention will become more apparent from the following description with respect to an embodiment as shown in accompanying drawings wherein.

DETAILED DESCRIPTION OF PREFERRED EMBODIMENTS

Figure 1:
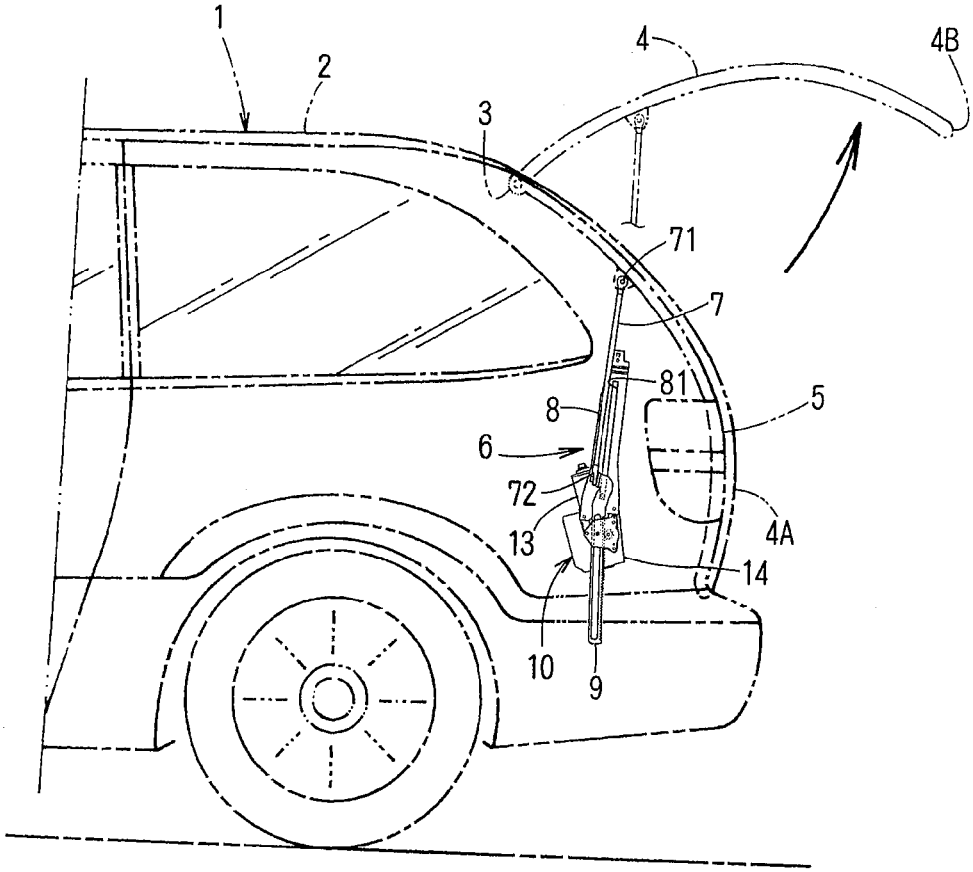
FIG. 1 is a side elevational view of a rear part of a vehicle including a door opening device according to the present invention.
Figure 2:
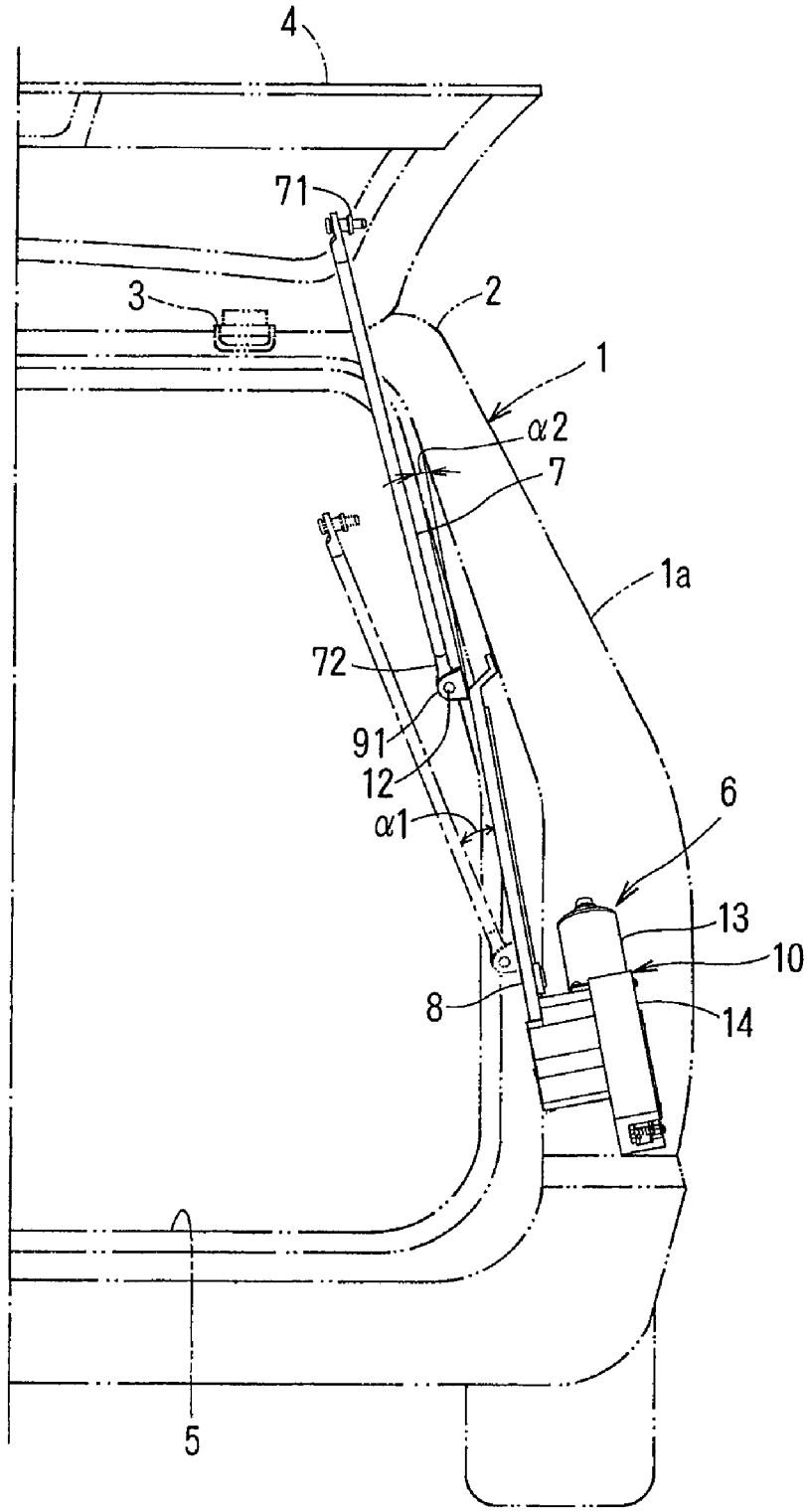
FIG. 2 is a rear elevational view of a right half of the rear part of the vehicle.

In FIGS. 1 and 2, at the rear end of a roof 2 of a body 1, a rear door 4 or a hatchback-type door at the back of a hatchback automobile is pivotally secured to move up and down open and close on a horizontal hinge shaft 3.

The rear door 4 moves in a closed position 4A that closes an opening 5 at the back of the body 1 and an open position 4B that opens the opening 5 so that the rear end jumps up.

At a right-side pillar 1*a* at the back of the body 1, an opening device 6 for opening and closing the rear door 4 automatically is equipped. In this embodiment, the opening device 6 is one-side driving type disposed at a right side at the back, but may be disposed at a left side. The opening device 6 may be both-side driving type at the right-and-left sides at the back of the body 1.

The opening device 6 comprises a connecting rod 7 in which the upper end 71 is coupled to the rear door 4 at a position far from the hinge shaft 3 to swing; a guide member 8 fixed to the pillar 1*a* so that a length is vertically oriented; a rack bar 9 supported by the guide member 8 to move up and down and coupled to the lower end 72 of the connecting rod 7 to enable the lower end 72 to swing; and a driving unit 10 for moving the rack bar 9 up and down to enable the rear door 4 to open and close via the connecting rod 7.

Figure 3:
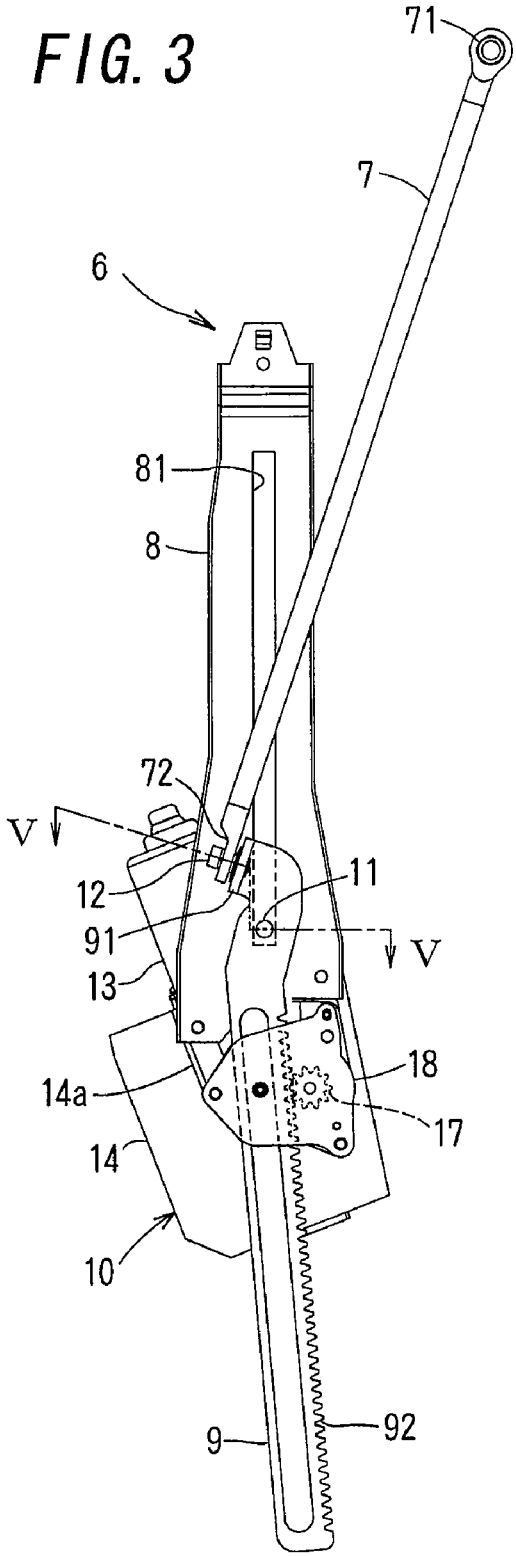
FIG. 3 is a side elevational view of a door opening device when a rear door is fully closed.
Figure 4:
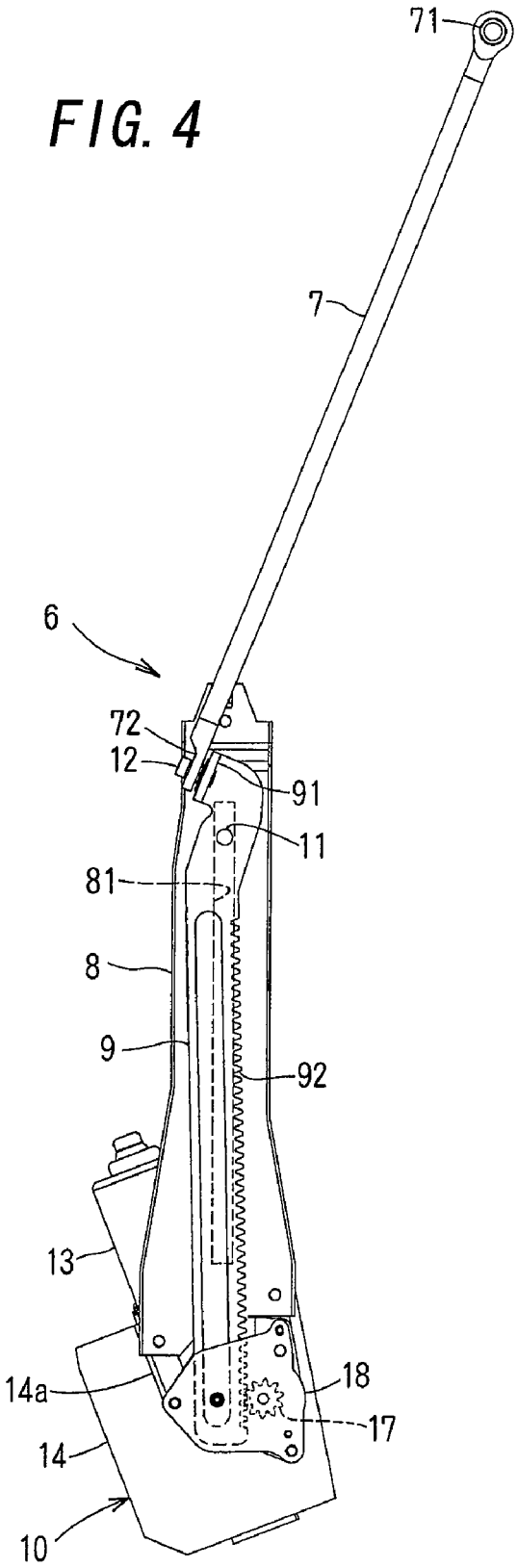
FIG. 4 is a side elevational view of the door opening device when the rear door fully opens.

In FIG. 2, the guide member 8 is fixed to the pillar 1*a* and inclined inwards along a side edge of the opening 5. A guide slit 81 is formed in a vertical direction in FIGS. 3 and 4. Around the guide groove 81, a flange portion is formed inward in FIG. 5.

The rack bar 9 is disposed at one side surface toward the inside of a car and engages in a guide slit 81 to move up and down with an engagement shaft 11. When the rear door 4 is in a closed position, the rack bar 9 moves to a lowered position in FIG. 3, while the rack bar 9 moves to a raised position when the rear door 4 is an open position in FIG. 4.

A connecting portion 91 which is bent toward the inside of the car is integrally formed with the upper end of the rack bar 9 and rack teeth 92 are formed vertically along a front side edge. The connecting portion 91 is formed at a position higher than a position where the engagement shaft 11 is fixed.

Figure 5:
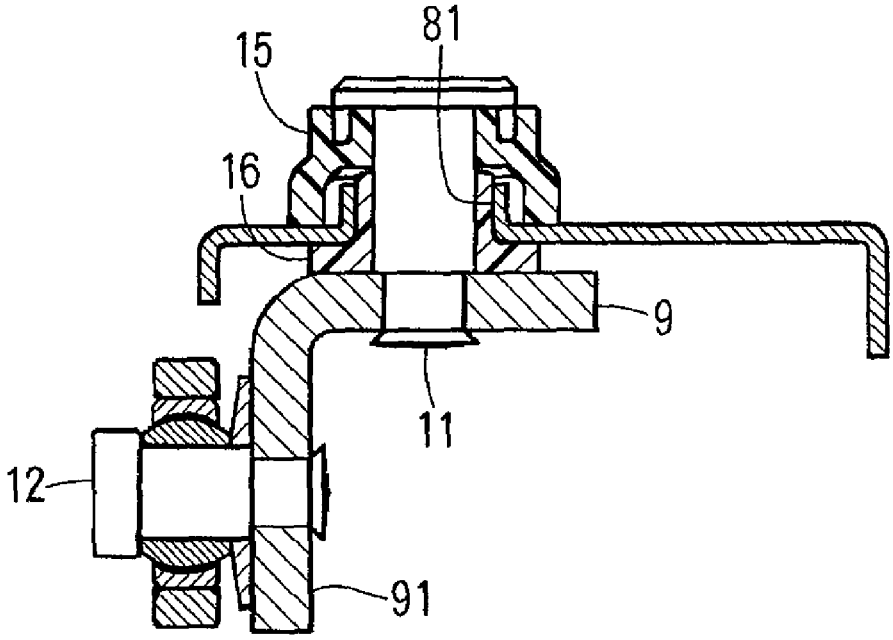
FIG. 5 is an enlarged horizontal sectional view taken along the line V-V in FIG. 3.
Figure 6:
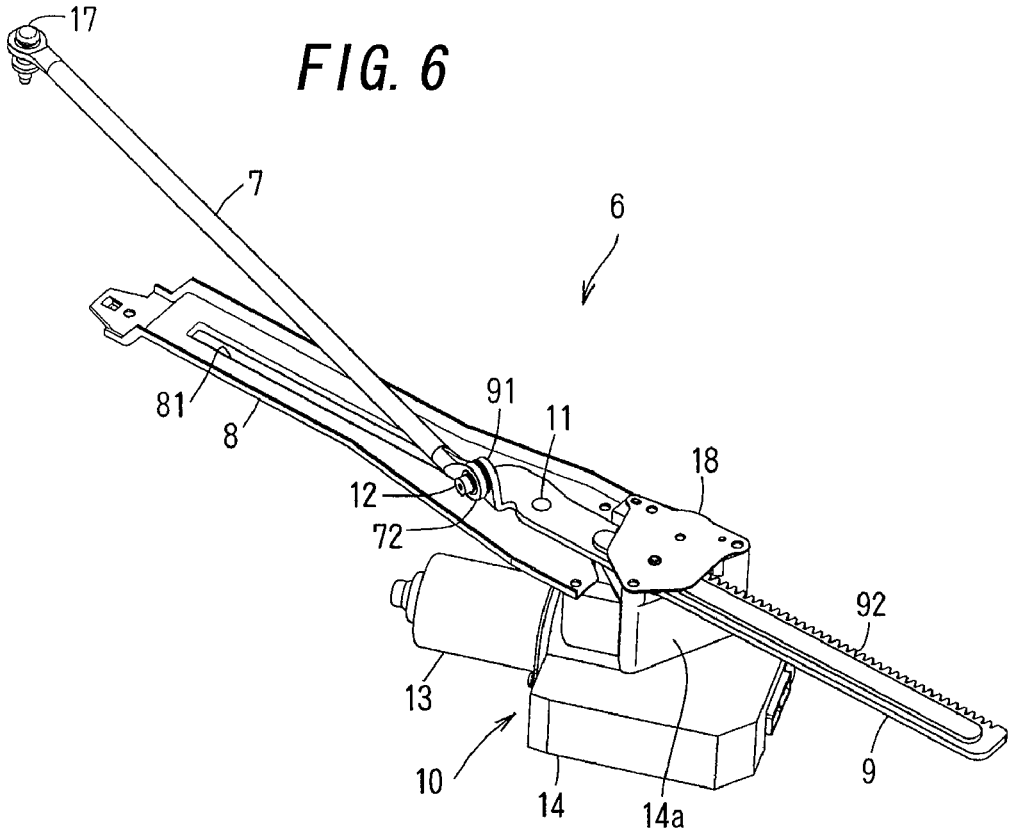
FIG. 6 is a perspective view of the door opening device seen from the inside of the vehicle.
Figure 7:
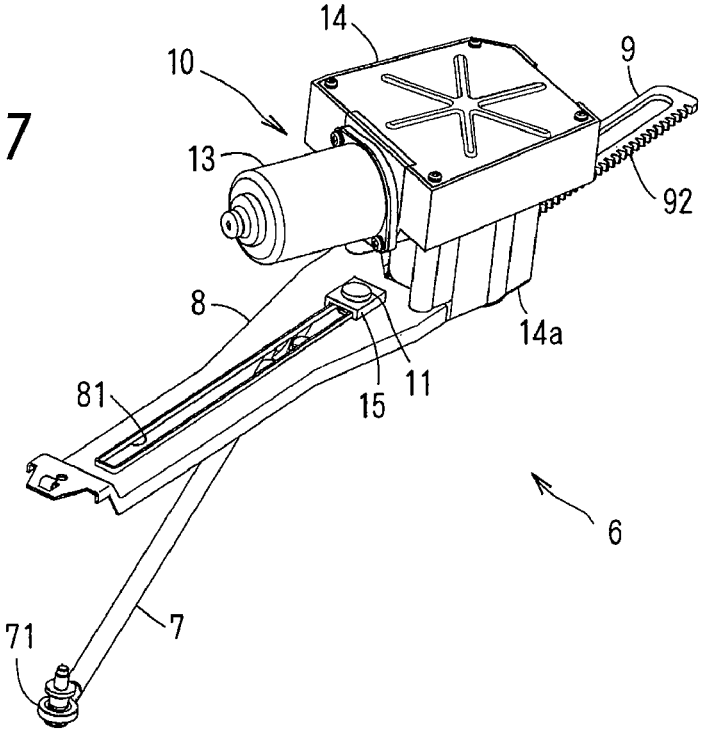
FIG. 7 is a perspective view of the door opening device seen from the outside of the vehicle.

In FIG. 5, the engagement shaft 11 engages in the guide slit 81 slidably up and down, and the end is fixed to an upper part of the rack bar 9. First and second sliders 15, 16 made of synthetic resin engage on the outer circumference of the engagement shaft 11 to make sliding of the engagement shaft 11 and rack bar 9 to the guide member 8 smooth.

The connecting rod 7 is disposed at one side surface of the guide member 8 or at the same side as the rack bar 9, and the lower end 72 is coupled swingingly to the connecting portion 91 of the rack bar 9 with the connecting shaft 12. On one side surface of the guide member 8, the connecting rod 7 can be easily connected to the rack bar 9 with the connecting shaft 12.

The connecting shaft 12 is axially disposed in a longitudinal direction of the car and the lower end 72 of the connecting rod 7 is coupled to the connecting portion 91 of the rack bar 9 so that the connecting rod 7 swings right and left.

A driving unit 10 is mounted to the lower part of the other side face of the guide member 8 which faces the outside of the car, and comprises a reversible motor 13 which starts by operation of an operating switch (not shown) and a reduction gear 14 for reducing rotation of the motor 13.

The reduction gear 14 comprises a housing 14*a* fixed to the lower surface of the guide member 8; an output gear 17 pivotally secured to the housing 14*a* to engage with the rack teeth 92 of the rack bar 9; and an electromagnetic clutch (not shown) in the housing 14*a* which connects and disconnects a transmission path between the motor 13 and the output gear 17.

The rack gear 9 which engages with the output gear 17 is disposed between the housing 14*a* and a holding plate 18 so as not to allow the rack gear 9 to loosen right and left.

When the electromagnetic clutch is magnetized to turn the motor 13 in a normal direction, the rack bar 9 moves up from the lowered position to allow the rear door 4 to open via the connecting rod 7. When the motor 13 is turned in a reverse direction, the rack bar 9 moves down from the raised position to allow the rear door 4 to close via the connecting rod 7. When the electromagnetic clutch is disconnected, the rear door 4 is opened and closed manually without subjecting resistance for turning the motor 13.

When the rear door 4 is opened and closed, the rack bar 9 moves diagonally and the upper end 71 of the connecting rod 7 in an almost vertically direction. Thus, in FIG. 2, an angle $\alpha$1 of the connecting rod 7 with respect to the rack bar 9 by dotted lines when the rear door 4 is closed changes to become larger than an angle $\alpha$2 when the rear door 4 is in an open position. However, in this embodiment, the lower end 72 of the connecting rod 7 is rotatably connected to the connecting portion 91 of the rack bar 9 with the connecting shaft 12, so that the connecting rod 7 swings right and left with opening and closing the rear door 4 thereby enabling the rear door 4 to open and close smoothly.

The foregoing relate to embodiment of the invention. Various changes and modifications below may be made without departing from the scope of claims:

(i) The connecting shaft 12 for rotatably joining the lower end 72 of the connecting rod 7 to the upper part of the rack bar 9 may be directed right and left.

(ii) The connecting rod 7 and rack bar 9 may be disposed to move along the other side surface of the guide member 8.

What is claimed is:

1. A door opening device in a vehicle that includes a door pivotally supported by a hinge shaft disposed on a body of the vehicle, the device comprising:

a connecting rod including an upper end and a lower end, said upper end being pivotally coupled to said door at a position spaced from the hinge shaft;

a guide member fixed to the vehicle body such that a longitudinal axis of said guide member extends generally vertically, said guide member having a guide slit extending generally vertically, the guide member having a first side facing an inside of the vehicle and a second side facing an outside of the vehicle;

a rack bar positioned at the first side of the guide member and including an engagement shaft that extends away from the rack bar in a first direction and engages in the guide slit of the guide member to enable the rack bar to move up and down along the guide slit, the rack bar comprising an upper end and a connecting portion at the upper end of the rack member, the connecting portion being bent at a right angle with respect to the upper end of the rack bar toward the inside of the vehicle, wherein the connecting portion extends away from the rack bar and said guide member in a second direction opposite to said first direction a connecting shaft having a longitudinal axis extending generally in a longitudinal direction of the vehicle body and connecting pivotally the lower end of the connecting rod to the upper end of the rack bar at the connecting portion of the rack bar; and a driving unit mounted on the second side of the guide member, and operable to drive said rack bar to move up and down thereby opening and closing said door via the connecting rod.

2. The door opening device of claim 1, wherein the device is positioned adjacent a side pillar at a back of the vehicle body.

3. The door opening device of claim 1, wherein the door comprises a hatchback door at a back of the vehicle body.

* * * * *